US006871028B2

(12) United States Patent
Rodriguez

(10) Patent No.: US 6,871,028 B2
(45) Date of Patent: Mar. 22, 2005

(54) IMAGE FORMING DEVICES, IMAGE FORMING DEVICE CONSUMABLE ASSEMBLIES AND IMAGE FORMING DEVICE COMMUNICATION METHODS

(75) Inventor: Santiago Rodriguez, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/423,537

(22) Filed: Apr. 24, 2003

(65) Prior Publication Data

US 2004/0213591 A1 Oct. 28, 2004

(51) Int. Cl.[7] ..... G03G 15/00

(52) U.S. Cl. ..... 399/24; 347/50; 399/27; 399/90

(58) Field of Search ..... 399/24, 25, 26, 399/27, 90, 107, 110, 111; 347/50

(56) References Cited

U.S. PATENT DOCUMENTS

| | | | | | |
|---|---|---|---|---|---|
| 5,510,884 | A | * | 4/1996 | Bov et al. | 399/90 X |
| 5,561,499 | A | * | 10/1996 | Setoriyama | 399/111 |
| 5,634,169 | A | * | 5/1997 | Barry et al. | 399/27 X |
| 5,893,662 | A | * | 4/1999 | Ito | 399/110 |
| 5,926,666 | A | * | 7/1999 | Miura et al. | 399/25 |
| 5,937,239 | A | * | 8/1999 | Watanabe et al. | 399/111 |
| 5,940,116 | A | * | 8/1999 | Park et al. | 399/110 X |
| 6,072,585 | A | * | 6/2000 | Dutton et al. | 399/90 X |
| 6,352,325 | B1 | | 3/2002 | Truffaut | |
| 2001/0014225 | A1 | * | 8/2001 | Otsubo et al. | 399/24 |
| 2002/0031359 | A1 | * | 3/2002 | Karakama et al. | 399/25 |
| 2002/0191981 | A1 | * | 12/2002 | Miyabe et al. | 399/90 |
| 2003/0063158 | A1 | | 4/2003 | Browning | |

FOREIGN PATENT DOCUMENTS

| | | |
|---|---|---|
| EP | 0789322 | 8/1997 |
| GB | 2321622 | 8/1998 |
| GB | 2375080 | 11/2002 |
| JP | 09-044057 | * 2/1997 |

* cited by examiner

*Primary Examiner*—Sophia S. Chen

(57) ABSTRACT

Image forming devices, image forming device consumable assemblies and image forming device communication methods are provided. One exemplary embodiment provides an image forming device configured to use a consumable to form hard images, the image forming device includes first electrical circuitry, second electrical circuitry spaced from the first electrical circuitry, the first electrical circuitry and the second electrical circuitry being configured to assist with the formation of hard images, a receptacle configured to receive a consumable assembly containing a supply of the consumable, a first electrical connection configured to electrically couple the first electrical circuitry with a conductor coupled with the consumable assembly when the consumable assembly is positioned within the receptacle and a second electrical connection configured to electrically couple the second electrical circuitry with the conductor coupled with the consumable assembly when the consumable assembly is positioned within the receptacle to electrically couple the first electrical circuitry and the second electrical circuitry.

31 Claims, 2 Drawing Sheets

IMAGE FORMING DEVICES, IMAGE FORMING DEVICE CONSUMABLE ASSEMBLIES AND IMAGE FORMING DEVICE COMMUNICATION METHODS

FIELD OF THE INVENTION

The invention relates to image forming devices, image forming device consumable assemblies and image forming device communication methods.

BACKGROUND OF THE INVENTION

Computers, including digital computers, have experienced expansive growth in sophistication and application in recent decades. Utilization of computers is ubiquitous in businesses and homes to assist with business operations, research, communications, etc. In many uses or applications of computing, it may be desired to create hard images of visual images including text, graphics, illustrations, etc. depicted using the monitor of the computer. Accordingly, numerous image forming devices have been created to assist with such hard imaging.

Image forming devices are configured to interface with the computer via an appropriate connection to receive image jobs, configuration commands and other appropriate communications. In addition, with the increasing popularity of networked environments, networked image forming devices are configured to couple with numerous computers to implement hard imaging. Alternatively, image forming devices may be utilized in stand alone applications.

Exemplary image forming device configurations include printers. Numerous printer configurations have been developed to accommodate various business and home usages. Some exemplary image forming device configurations include monochrome printers, color printers, laser printers, ink-jet printers, and impact printers.

Image forming devices have numerous configurations for numerous uses and applications. Reduced space and/or utilization of a minimal number of components is desired for some designs. At least some embodiments of the invention address these objectives.

SUMMARY OF THE INVENTION

The invention relates to image forming devices, image forming device consumable assemblies and image forming device communication methods.

According to one embodiment of the invention, an image forming device configured to use a consumable to form hard images comprises first electrical circuitry, second electrical circuitry spaced from the first electrical circuitry, the first electrical circuitry and the second electrical circuitry being configured to assist with the formation of hard images, a receptacle configured to receive a consumable assembly containing a supply of the consumable, a first electrical connection configured to electrically couple the first electrical circuitry with a conductor coupled with the consumable assembly when the consumable assembly is positioned within the receptacle and a second electrical connection configured to electrically couple the second electrical circuitry with the conductor coupled with the consumable assembly when the consumable assembly is positioned within the receptacle to electrically couple the first electrical circuitry and the second electrical circuitry.

Another embodiment provides an image forming device consumable assembly configured to couple with an image forming device and comprising a housing adapted to house a consumable having a fixed life span for use in an image forming device to form hard images and an electrical conductor supported by the housing and configured to electrically couple a first external portion of the housing and a second external portion of the housing spaced from the first portion.

According to yet another embodiment, an image forming device communication method comprises providing first electrical circuitry and second electrical circuitry arranged in a spaced relationship within an image forming device, electrically coupling the first electrical circuitry and the second electrical circuitry with an electrical conductor of a consumable assembly received within the image forming device, providing an electrical signal using one of the first electrical circuitry and the second electrical circuitry, and communicating the electrical signal from the one of the first electrical circuitry and the second electrical circuitry to the other of the first electrical circuitry and the second electrical circuitry using electrical conductor of the consumable assembly.

Other embodiments are provided, some of which are disclosed herein.

DETAILED DESCRIPTION OF THE INVENTION

Figure 1:
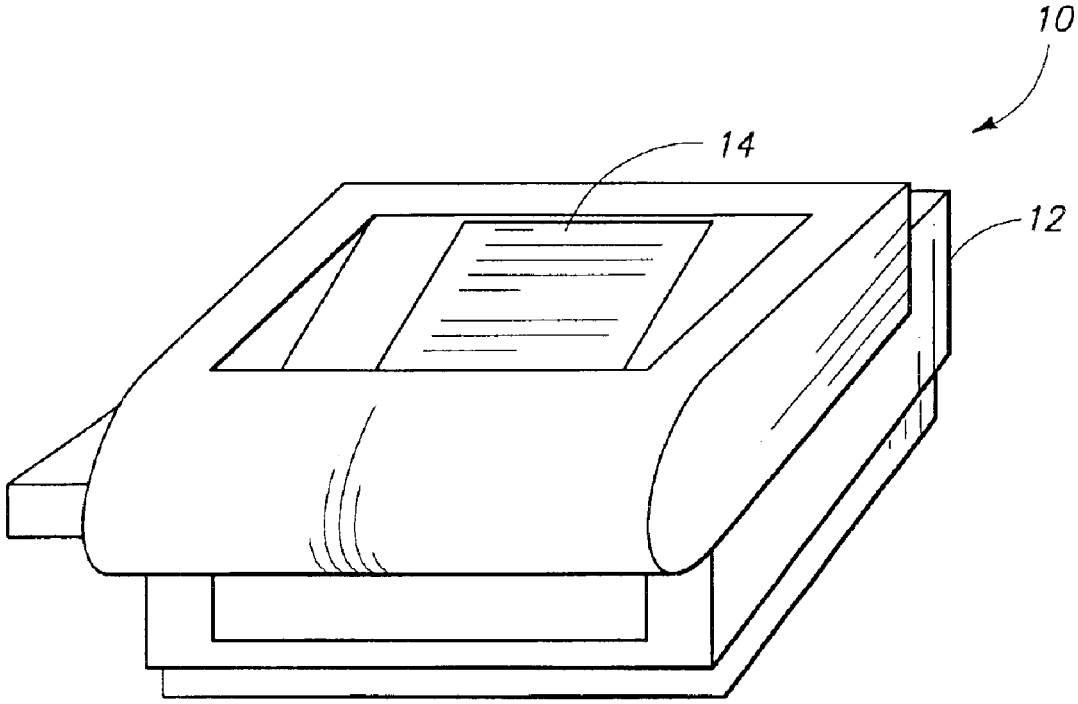
FIG. 1 is an isometric view of an image forming device according to one exemplary embodiment.

FIG. 1 depicts an exemplary configuration of an image forming device 10 having a housing 12. Device 10 is configured to form hard images. Exemplary image forming devices 10 include printers (e.g., ink-jet, laser, impact, etc.), facsimile devices, copiers, multiple-function devices, or other devices capable of forming hard images upon imaging media 14. Exemplary hard images include images provided upon output media 14 and comprise printed media in one example.

Image forming device 10 utilizes one or more consumable to form hard images. Consumables have fixed life spans and are expended during imaging operations. Exemplary consumables utilized within an image forming device 10 implemented as a printer, for example, include imaging media 14 (e.g., paper, transparencies, roll media, etc.), marking agents (e.g., toner, ink), components having fixed life spans (e.g., fuser assembly), and other expendable items (e.g., developer cartridge, imaging drum assembly) utilized to complete desired jobs. Typically, a consumable is replaced or replenished upon consumption of the useful life of the consumable. Other consumables may be utilized in other printer configurations or other image forming device configurations.

Image forming device 10 is configured in at least one embodiment to couple with one or more host device (not shown). The host device may be implemented as a stand alone personal computer, or alternatively, a plurality of computers may be provided in a networked environment. Other host device configurations such as computer work stations are possible.

In some applications, the host device provides image data to be imaged (e.g., word processing text, spread sheets, illustrations, graphics, etc.) to image forming device 10. The host device may also be utilized to reconfigure or control operations of image forming device 10, using respective printer driver software, for example. Alternatively or in addition to receiving external image data (i.e., to be imaged using device 10), image data may be generated or otherwise originated internally of image forming device 10.

Figure 2:
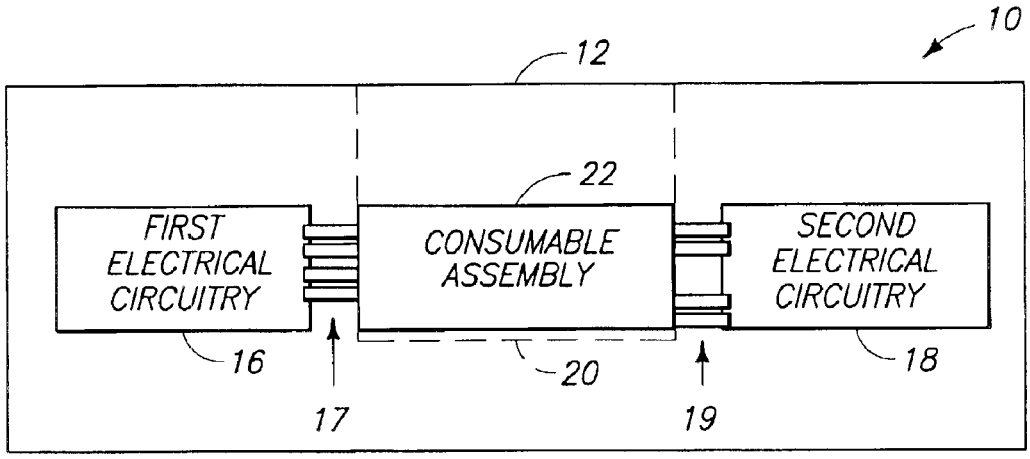
FIG. 2 is a functional block diagram depicting components of the exemplary image forming device according to one embodiment.

Referring to FIG. 2, additional details of an exemplary image forming device 10 are shown. The depicted device 10 includes first electrical circuitry 16, second electrical circuitry 18, and a consumable receptacle 20. Receptacle 20 is configured to receive a consumable assembly 22 as illustrated in FIG. 2. In the described exemplary printer configuration of device 10, receptacle 20 may be implemented as a bay configured to receive a mating consumable assembly 22 arranged as an electrophotographic EP toner cartridge, for example. Other configurations of consumable receptacle 20 and consumable assembly 22 are contemplated. In the exemplary depicted embodiment, first electrical circuitry 16 and second electrical circuitry 18 are positioned adjacent to opposing sides of receptacle 20 in the depicted configuration.

Figure 3:
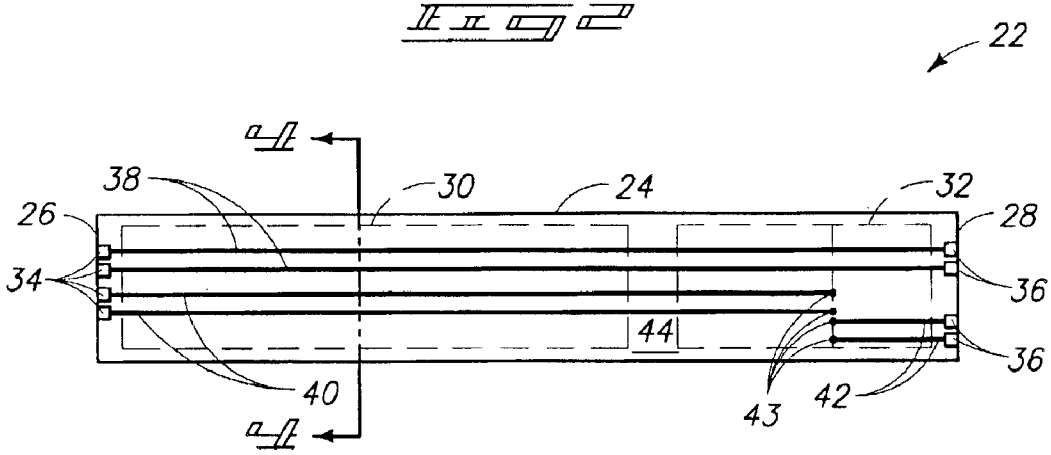
FIG. 3 is an illustrative representation of an exemplary consumable assembly usable within an image forming device according to one embodiment.

The exemplary image forming device 10 includes a plurality of first electrical connections 17 and second electrical connections 19. Electrical connections 17, 19 are illustrated between respective ones of first electrical circuitry 16 and second electrical circuitry 18, and consumable assembly 22. Electrical connections 17, 19 are configured to provide electrical coupling of respective ones of first and second electrical circuitry 16, 18 with circuitry of consumable assembly 22 (exemplary circuitry of consumable assembly 22 is shown in FIG. 3 arranged to couple with electrical connections 17, 19). First and second electrical connections 17, 19 comprise conductive metals in at least one arrangement and may be implemented as knife contacts or other appropriate conductive configurations.

First electrical circuitry 16 and second electrical circuitry 18 refer to circuits which are physically spaced from one another within housing 12 of image forming device 10 in the illustrated exemplary embodiment. In one embodiment, first electrical circuitry 16 and second electrical circuitry 18 are configured to assist with the formation of hard images using image forming device 10. First electrical circuitry 16 and second electrical circuitry 18 may refer to any electrical circuitry, assemblies, components, modules, packages, or electrical configurations of image forming device 10 which are physically spaced from one another. For example, first and second electrical circuitry 16, 18 may be implemented as spaced PC boards, separate modules, within discrete circuit packages, or a combination of different circuit configurations.

In one exemplary image forming device configuration, first electrical circuitry 16 comprises digital circuitry including processing circuitry (e.g., microprocessor, hardware logic circuitry, etc.), memory circuitry, controllers, etc. Second electrical circuitry 18 in such an exemplary embodiment can comprise electro-mechanical device control circuitry and/or electro-mechanical loads, such as motors, solenoids, fans, clutches, etc., for implementing imaging operations.

In a more specific exemplary configuration, first electrical circuitry 16 comprises a formatter controller board including a processor configured to rasterize received image jobs prior to the formation of hard images, and memory configured to store the image data and/or rasterized data. In accordance with the presently described exemplary configuration, second electrical circuitry 18 comprises an engine DC controller configured to control imaging components of device 10 (e.g., developing assembly, fuser, etc.) for implementing hard imaging of the rasterized data. For example, second electrical circuitry 18 controls components (e.g., rollers) to guide media along a paper path of image forming device 10 and to form images upon media 14 using the rasterized data from first electrical circuitry 16. In such a configuration, first electrical circuitry 16 operates at an exemplary voltage reference of 3.3 Volts or 5 Volts while second electrical circuitry 18 may operate at higher voltages such as 12 Volts, 24 Volts or 1,400 Volts. In a configuration wherein first electrical circuitry 16 comprises formatter circuitry and second electrical circuitry 18 comprises electro-mechanical device control circuitry, first electrical circuitry 16 controls operations of the second electrical circuitry 18 responsive to receiving an image job and rasterizing image data of the image job.

The described configuration of image forming device 10 including electrical circuitry 16, 18 implemented as respective formatter circuitry and DC controller circuitry illustrates an exemplary embodiment and other arrangements are contemplated having different first and second electrical circuitry configurations physically spaced or separated from one another within image forming device 10.

Consumable assembly 22 is configured to couple with image forming device 10 and to provide a consumable for use within image forming device 10. One exemplary consumable assembly 22 is implemented as a toner cartridge in an exemplary laser printer image forming device configuration. Alternative consumable assemblies 22 are contemplated and may be implemented as media supply assemblies, fuser assemblies or other consumable assemblies usable within an image forming device.

Image forming device 10 includes one or more first electrical connection 17 and one or more second electrical connection 19 (a plurality of respective electrical connections 17, 19 are shown in the depicted exemplary embodiment of FIG. 2). First electrical connections 17 are configured to electrically couple first electrical circuitry 16 with one or more conductor supported by the consumable assembly 22 when the consumable assembly 22 is positioned within receptacle 20 as shown in FIG. 2. Exemplary consumable assembly configurations are depicted in FIGS. 3, 4, 4*a*, and 5 including respective conductor configurations. Second electrical connections 19 are configured to electrically couple the second electrical circuitry 18 with the one or more conductor coupled with the consumable assembly 22 when the consumable assembly 22 is positioned within the receptacle 20 as illustrated in FIG. 2.

Referring to FIG. 3, an exemplary consumable assembly 22 for use with an image forming device is illustrated. The depicted exemplary consumable assembly 22 is implemented as a toner cartridge in accordance with the exemplary described printer application. Other consumable assembly configurations are possible including other assemblies for the described printer application (e.g., media supply tray) or appropriate assemblies for other image forming device configurations (e.g., copier, facsimile device, multiple-function devices, etc.).

The illustrated exemplary consumable assembly 22 includes a housing 24 comprising opposing wails 26, 28. Housing 24 is arranged to house a consumable reservoir 30 configured to contain the appropriate consumable and digital circuitry 32 in the depicted exemplary configuration. Reservoir 30 houses the consumable having a fixed life span for use within image forming device 10 to form hard images. Digital circuitry 32 is implemented in one configuration as a digital memory device containing digital information relative to consumable assembly 22. Upon insertion of consumable assembly 22 into receptacle 20 of image forming device 10, internal circuitry of device 10 (e.g., first and second electrical circuitry 16, 18) is provided in electrical communication with digital circuitry 32 as described further below in one exemplary configuration. Digital circuitry 32 may be embedded within an appropriate enclosure of consumable assembly 22.

In the embodiment wherein consumable assembly 22 is implemented as a toner cartridge, reservoir 30 is arranged to contain a supply of toner for use within image forming device 10. Consumable assembly 22 includes an aperture (not shown) permitting the consumable within reservoir 30 to be supplied to image forming device 10. Other consumable assemblies include consumables (e.g., fuser assemblies) without a reservoir.

Consumable assembly 22 includes one or more electrical conductor supported by housing 24 in the depicted exemplary arrangement and configured to electrically couple a first external portion of the consumable assembly 22 and a second external portion of the consumable assembly 22 spaced from the first portion. In the depicted exemplary configuration of FIG. 3, plural such electrical conductors 38, 40, 42 are shown supported by housing 24. Consumable assembly 22 includes a plurality of electrical contacts 34, 36 electrically connected with appropriate conductors 38, 40, 42 as shown. Housing 24 and the electrical conductors 38, 40, 42 are configured for electrically coupling of the electrical conductors 38, 40, 42 with respective electrical connections 17, 19 of image forming device 10 upon coupling of the consumable assembly 22 with the image forming device 10. Electrical conductors 38, 40, 42 may communicate electrical control signals, electrical data signals, electrical voltages references or any other appropriate electrical signals. First electrical circuitry 16 and second electrical circuitry 18 may be commonly grounded using an appropriate ground not shown (e.g., carried within housing 12 or using ground internal to one or both of first and second electrical circuitry 16, 18 or other appropriate ground) and using one or more of electrical conductors 38, 40, 42. In accordance with one embodiment, one or more of conductors 38, 40, 42 may comprise a ground conductor.

The plurality of electrical contacts 34, 36 couple appropriate ones of electrical conductors 38, 40, 42 with respective first electrical connections 17 and second electrical connections 19 in the illustrated configuration. Alternatively, electrical conductors 38, 40, 42 may be arranged for direct electrical coupling with respective electrical connections 17, 19.

In the depicted arrangement, electrical conductors 38 provide electrically conductive paths intermediate opposing walls 26, 28 of consumable assembly housing 24. Electrical conductors 40 provide electrical conduction from exterior wall 26 to a location of consumable assembly 22 spaced from wall 26. Electrical conductors 42 provide electrical conduction from wall 28 of housing 24 to remotely spaced portions of consumable assembly 22. The illustrated configuration illustrates an exemplary embodiment. More or less conductors may be provided in other configurations, and such conductors may be coupled with other possible locations of consumable assembly 22, for example.

In the exemplary configuration depicted in FIG. 3, electrical conductors 40, 42 provide electrical coupling of portions of housing 24 adjacent to the respective walls 26, 28 to internal locations adjacent to digital circuitry 32. A plurality of vias and via conductors 43 may be formed within housing 24 to provide electrical connection of the conductors 40, 42 to digital circuitry 32 located within housing. Alternatively, digital circuitry 32 may be mounted directly upon the external portions of housing 24 wherein direct electrical connection of digital circuitry 32 and the conductors 40, 42 is possible.

Upon coupling of consumable assembly 22 with image forming device 10 to implement access of image forming device 10 to the consumable of consumable assembly 22, electrical conductors 38 provide electrical coupling of first electrical circuitry 16 and second electrical circuitry 18 via electrical connections 17, 19. Electrical signals originating within one of first electrical circuitry 16 and second electrical circuitry 18 may be communicated to the other respective one of first electrical circuitry 16 and second electrical circuitry 18 using electrical conductors 38.

As illustrated, electrical conductors 40, 42 provide coupling of digital circuitry 32 with spaced portions of housing 24 including exterior housing walls 26, 28 as shown in the exemplary embodiment. Accordingly, first electrical circuitry 16 is provided in an electrical communication with digital circuitry 32 using electrical connections 17 and electrical conductors 40. Second electrical circuitry 18 is provided in electrical communication with digital circuitry 32 using electrical conductors 42 and electrical connections 19. As depicted, respective conductors 38, 40, 42 provide parallel communication of electrical signals in the exemplary embodiment.

Figure 4:
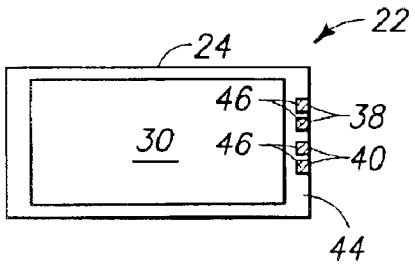
FIG. 4 is a cross-sectional view of the consumable assembly depicted in FIG. 3.

Referring to FIG. 4, further details of the exemplary configuration of consumable assembly 22 of FIG. 3 are shown. Consumable housing 24 includes a sidewall 44 defining a portion of reservoir 30. Sidewall 44 comprises an exterior wall configured to support electrical conductors of consumable assembly 22. In the depicted exemplary consumable assembly 22, exterior wall 44 includes a plurality of recessed channels 46 etched into exterior wall 44. Conductors 38, 40 are formed within the recessed channels 46. Electrical conductors 38, 40 may be printed or otherwise formed within recessed channels 46.

Figure 4A:
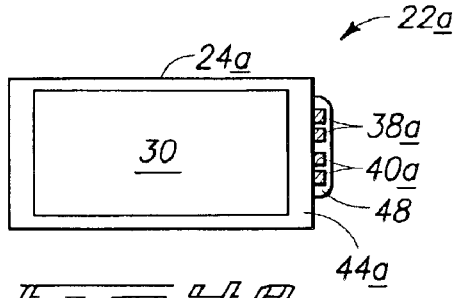
FIG. 4*a* is a cross-sectional view of an alternative configuration of the consumable assembly depicted in FIG. 3 according to one embodiment.

Referring to FIG. 4*a*, an alternative configuration of housing 24*a* of a consumable assembly 22*a* is shown. Channels 46 have been omitted from exterior wall 44*a*. Electrical conductors 38*a* and 40*a* are physically coupled with an adhesive tape 48 which is applied to appropriate portions of exterior wall 44*a* to provide appropriate electrical coupling of circuitry using electrical conductors 38*a*, 40*a*. Adhesive tape 48 is substantially electrically insulative in the illustrated arrangement. The configurations of FIGS. 4 and 4*a* are provided to depict exemplary arrangements according to embodiments of the invention.

Figure 5:
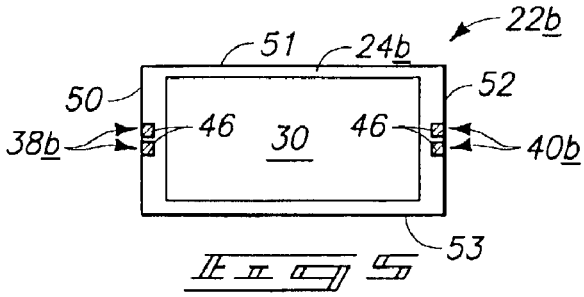
FIG. 5 is a cross-sectional view of another exemplary configuration of a consumable assembly according to one embodiment.

Referring to FIG. 5, housing 24*b* of another exemplary consumable assembly 22*b* is shown. Housing 24*b* comprises a plurality of sides 50–53 and electrical conductors 38*b*, 40*b* are coupled with respective sides 50, 52 of housing 24*b*. In the exemplary embodiment, sides 50, 52 are opposing sides to reduce interference between electrical signals conducted within respective opposing electrical conductors 38*b*, 40*b*. In one embodiment, the electrical conductors 38*b*, 40*b* conduct respective groups of electrical signals having respective different voltage ranges (e.g., conductors 38*b* conduct signals of increased voltages 0–1400 (or more) Volts compared with conduction of signals, having voltages of 0–5 Volts using conductors 40*b* in one possible embodiment). Other constructions are possible.

Accordingly, embodiments of the present invention facilitate electrical coupling of electrical circuitry external to a consumable assembly with circuitry, such as digital circuitry, coupled with, embedded within, or otherwise supported by the consumable assembly. Further, embodiments of the invention reduce the presence of electrical couplings within a housing of an image forming device.

The protection sought is not to be limited to the disclosed embodiments, which are given by way of example only, but instead is to be limited only by the scope of the appended claims.

What is claimed is:

1. An image forming device configured to use a consumable to form hard images, the image forming device comprising:

first electrical circuitry;

second electrical circuitry spaced from the first electrical circuitry, the first electrical circuitry and the second electrical circuitry being configured to assist with the formation of hard images;

a receptacle configured to receive a consumable assembly containing a supply of the consumable;

a first electrical connection configured to electrically couple the first electrical circuitry with a conductor coupled with the consumable assembly when the consumable assembly is positioned within the receptacle; and a second electrical connection configured to electrically couple the second electrical circuitry with the conductor coupled with the consumable assembly when the consumable assembly is positioned within the receptacle to electrically couple the first electrical circuitry and the second electrical circuitry.

2. The device of claim 1 further comprising a plurality of first electrical connections and a plurality of second electrical connections.

3. The device of claim 2 wherein at least one of the first electrical connections and the second electrical connections is configured to couple a respective one of the first electrical circuitry and the second electrical circuitry with digital circuitry of the consumable assembly.

4. The device of claim 1 wherein the first electrical circuitry and the second electrical circuitry are located adjacent to opposing sides of the receptacle with the receptacle provided between the first electrical circuitry and the second electrical circuitry.

5. The device of claim 1 wherein the first electrical circuitry comprises digital circuitry and the second electrical circuitry comprises electro-mechanical device control circuitry.

6. The device of claim 5 wherein the first electrical circuitry comprises formatter circuitry and the second electrical circuitry comprises DC controller circuitry.

7. The device of claim 1 wherein the first electrical circuitry is configured to control operations of the second electrical circuitry.

8. The device of claim 1 wherein the first electrical circuitry and the second electrical circuitry are configured to assist with the printing of hard images.

9. The device of claim 1 wherein the first electrical connection and the second electrical connection are located externally of the receptacle.

10. The device of claim 1 wherein the first electrical circuitry comprises processing circuitry located externally of the receptacle.

11. The device of claim 1 further comprising a housing, and wherein the first electrical connection and the second electrical connection remain within the housing when the consumable assembly is removed from the receptacle.

12. An image forming device consumable assembly configured to couple with an image forming device, the image forming device consumable assembly comprising:

a housing adapted to house a consumable having a fixed life span for use in an image forming device to form hard images; and an electrical conductor supported by the housing and configured to electrically couple a first external portion of the housing and a second external portion of the housing spaced from the first portion.

13. The assembly of claim 12 wherein the housing comprises an exterior wall and the conductor is supported by the exterior wall.

14. The assembly of claim 13 wherein the exterior wall comprises a recessed channel and conductor resides within the recessed channel.

15. The assembly of claim 12 wherein the electrical conductor is coupled with an adhesive tape.

16. The assembly of claim 12 wherein the housing comprises a toner cartridge housing adapted to house the consumable comprising toner.

17. The assembly of claim 12 further comprising digital circuitry supported by the housing, and the electrical conductor is electrically coupled with the digital circuitry.

18. The assembly of claim 12 wherein the housing and the electrical conductor are configured to electrically couple the electrical conductor with electrical connections of the image forming device upon coupling of the consumable assembly with the image forming device.

19. The assembly of claim 12 wherein the housing comprises a plurality of sides and the electrical conductor is coupled with one of the sides, and further comprising an other electrical conductor coupled with an other of the sides.

20. The assembly of claim 19 wherein the one and the other sides comprise opposing sides of the housing.

21. The assembly of claim 20 wherein the electrical conductors conduct respective groups of electrical signals having different voltage ranges.

22. The assembly of claim 12 wherein the electrical conductor comprises a ground conductor.

23. The assembly of claim 12 wherein substantially an entirety of the electrical conductor is directly supported by the housing.

24. The assembly of claim 12 further comprising a first electrical contact at the first external portion of the housing and a second electrical contact at the second external portion of the housing, and wherein the first and second electrical contacts are in contact with and directly supported by the housing.

25. An image forming device communication method comprising:

providing first electrical circuitry and second electrical circuitry arranged in a spaced relationship within an image forming device;

electrically coupling the first electrical circuitry and the second electrical circuitry with an electrical conductor of a consumable assembly received within the image forming device;

providing an electrical signal using one of the first electrical circuitry and the second electrical circuitry; and communicating the electrical signal from the one of the first electrical circuitry and the second electrical circuitry to the other of the first electrical circuitry and the second electrical circuitry using the electrical conductor of the consumable assembly.

26. The method of claim 25 wherein the providing the first electrical circuitry and the second electrical circuitry comprises respectively providing digital circuitry and electromechanical device control circuitry.

27. The method of claim 26 wherein the providing the first electrical circuitry and the second electrical circuitry comprises respectively providing formatter circuitry and DC controller circuitry.

28. The method of claim 25 further comprising:

providing another electrical signal using another one of the first electrical circuitry and the second electrical circuitry; and communicating the another electrical signal from the another one of the first electrical circuitry and the second electrical circuitry to digital circuitry of the consumable assembly.

29. The method of claim 25 wherein the electrically coupling comprises electrically coupling the first electrical circuitry and the second electrical circuitry with a plurality of electrical conductors of the consumable assembly, and the providing the electrical signal comprises providing a plurality of electrical signals, and the communicating comprises communicating the electrical signals in parallel using the electrical conductors.

30. The method of claim 25 further comprising providing the image forming device comprising a printer.

31. The method of claim 25 further comprising providing a common ground for the first electrical circuitry and the second electrical circuitry using an other electrical conductor of the consumable assembly.

* * * * *